US011435087B2

(12) United States Patent
Paller

(10) Patent No.: US 11,435,087 B2
(45) **Date of Patent: *Sep. 6, 2022**

(54) MULTI-CAVITY OVEN APPLIANCE WITH ONE HEATING ELEMENT PER CAVITY

(71) Applicant: Haier US Appliance Solutions, Inc., Wilmington, DE (US)

(72) Inventor: Hans Juergen Paller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 747 days.

This patent is subject to a terminal disclaimer.

(21) Appl. No.: 16/362,925

(22) Filed: Mar. 25, 2019

(65) Prior Publication Data

US 2020/0309379 A1 Oct. 1, 2020

(51) Int. Cl.

| | |
|---|---|
| ***F24C 7/08*** | (2006.01) |
| ***F24C 15/02*** | (2006.01) |
| ***F24C 15/32*** | (2006.01) |
| ***F24C 15/16*** | (2006.01) |
| ***F24C 15/04*** | (2006.01) |

(52) U.S. Cl.
CPC ..... *F24C 7/081* (2013.01); *F24C 15/028* (2013.01); *F24C 15/04* (2013.01); *F24C 15/16* (2013.01); *F24C 15/322* (2013.01)

(58) Field of Classification Search
CPC ..... F24C 7/081; F24C 15/322; F24C 15/028; F24C 15/04; F24C 15/16
See application file for complete search history.

(56) References Cited

U.S. PATENT DOCUMENTS 2,098,295 A * 11/1937 Kettering ..... A61N 1/403 34/255
4,108,139 A 8/1978 Gilliom et al.
4,455,478 A * 6/1984 Guibert ..... A47J 39/003 219/400
4,527,538 A 7/1985 Caferro
4,951,645 A * 8/1990 Luebke ..... A21B 1/245 99/474
5,454,295 A * 10/1995 Cox ..... A21B 1/48 99/332

(Continued)

FOREIGN PATENT DOCUMENTS

CA 2003711 A1 * 6/1990 ..... A21B 1/245

*Primary Examiner* — Jorge A Pereiro
*Assistant Examiner* — Nikhil P Mashruwala
(74) *Attorney, Agent, or Firm* — Dority & Manning, P.A.

(57) ABSTRACT

An oven appliance defines a vertical direction, a lateral direction and a transverse direction. The vertical, lateral and transverse directions are mutually perpendicular. The oven appliance includes a cabinet extending between a first side portion and a second side portion along the lateral direction. The cabinet also extends between a top portion and a bottom portion along the vertical direction. The cabinet defines an upper cooking chamber positioned adjacent the top portion of the cabinet and a lower cooking chamber positioned adjacent the lower portion of the cabinet. The oven appliance also includes a first heating element in direct thermal communication with the upper cooking chamber and a second heating element in direct thermal communication with the lower cooking chamber.

16 Claims, 12 Drawing Sheets

(56) References Cited

U.S. PATENT DOCUMENTS

| | | | | |
|---|---|---|---|---|
| 7,422,009 | B2 | 9/2008 | Rummel et al. | |
| 7,784,457 | B2 * | 8/2010 | Akdag | F24C 15/322 126/21 R |
| 9,677,774 | B2 * | 6/2017 | McKee | F24C 15/166 |
| 10,890,336 | B2 * | 1/2021 | McKee | F24C 15/325 |
| 10,976,054 | B2 * | 4/2021 | Paller | F24C 3/004 |
| 2012/0037142 | A1 * | 2/2012 | Chilton | F24C 15/006 126/21 R |

* cited by examiner

MULTI-CAVITY OVEN APPLIANCE WITH ONE HEATING ELEMENT PER CAVITY

FIELD OF THE INVENTION

The present subject matter relates generally to multi-cavity oven appliances, such as double oven range appliances.

BACKGROUND OF THE INVENTION

Various oven appliance may include more than one cooking chamber. For example, such multi-cavity oven appliances may include double oven range appliances having upper and lower cooking chambers. A user of the double oven range appliances may conveniently utilize either or both of the upper and lower cooking chambers to cook food items. In certain double oven range appliance, the upper cooking chamber is smaller than the lower cooking chamber. Thus, the user may utilize the upper cooking chamber to cook smaller food items and the lower cooking chamber to cook larger food items.

Heating a multi-cavity oven appliance to properly cook/bake foods requires being able to supply heat to each oven cavity substantially independent of the other cavity or cavities. Traditionally, this has been accomplished by supplying a bake burner to each oven cavity, a broil burner to at least one of the cavities and optionally an additional heat source with a fan for convection. This requires independent burners or electric elements for each of these heat sources. Such configurations can be costly, reduce the usable cooking volume within the oven appliance, add complexity, and may reduce reliability of the oven appliance. For example, multi-cavity oven appliances utilizing gas systems may face baking performance limitations. Only one gas burner can be ignited in any cavity at a given time because simultaneous burner operation may result in poor combustion. In such systems, transitioning between bake and broil can require significant time since one burner needs to be turned off and then the other ignited. As another example, typical multi-cavity oven appliances only provide convection heating in one cavity or the additional cost of another convection system must be added to provide convection in other cavities.

Accordingly, a multi-cavity oven appliance with features for providing flexible operation of the oven appliance, e.g., by selectively directing heat to one or more of the multiple cavities would be useful. In addition, a multi-cavity oven appliance with features which provide flexible operation while minimizing the footprint of the heating system within the oven appliance would be useful.

BRIEF DESCRIPTION OF THE INVENTION

Aspects and advantages of the invention will be set forth in part in the following description, or may be apparent from the description, or may be learned through practice of the invention.

In one exemplary embodiment, an oven appliance is provided. The oven appliance defines a vertical direction, a lateral direction and a transverse direction. The vertical, lateral and transverse directions are mutually perpendicular. The oven appliance includes a cabinet extending between a first side portion and a second side portion along the lateral direction. The cabinet also extends between a top portion and a bottom portion along the vertical direction. The cabinet defines an upper cooking chamber positioned adjacent the top portion of the cabinet and a lower cooking chamber positioned adjacent the lower portion of the cabinet. The oven appliance also includes a first heating element in thermal communication with the upper cooking chamber and a second heating element in thermal communication with the lower cooking chamber.

In another exemplary embodiment, an oven appliance is provided. The oven appliance includes a cabinet with an upper cooking chamber defined in the cabinet adjacent a top portion of the cabinet and a lower cooking chamber defined in the cabinet below the upper cooking chamber and adjacent a lower portion of the cabinet. The oven appliance also includes a first heating element in thermal communication with the upper cooking chamber and a second heating element in thermal communication with the lower cooking chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
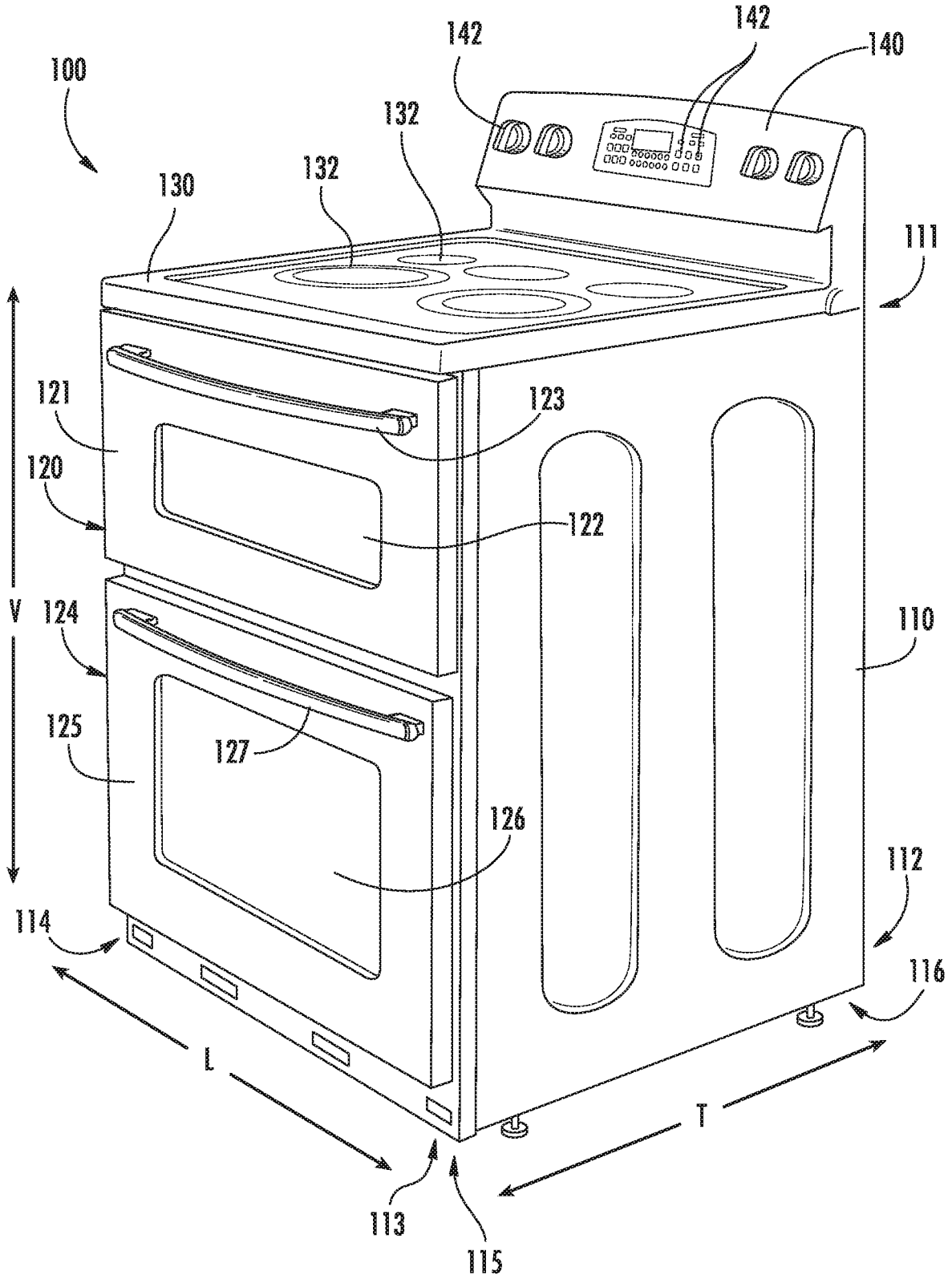
FIG. 1 provides a perspective views of an oven range appliance according to one or more exemplary embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a multi-cavity oven range appliance 100 according to an exemplary embodiment of the present subject matter. In the example illustrated in FIG. 1 the oven range appliance is a double oven appliance including two cavities. It is to be understood that such is by way of example only, additional embodiments of the present disclosure may include three or more cavities. In the illustrated example, the multi-cavity oven appliance 100 includes a separate door for each cavity, e.g., an upper door 121 and a lower door 125 corresponding to the upper and lower cavities, respectively. In additional embodiments, a single door may be provided for simultaneous access to all of the multiple cavities within the oven appliance 100. Other combinations and variations are also possible, for example a triple cavity oven appliance with two doors, etc.

As may be seen in FIG. 1 oven appliance 100 defines a vertical direction V, a lateral direction L and a transverse direction T. The vertical, lateral and transverse directions are mutually perpendicular and form an orthogonal direction system.

Oven appliance 100 includes an insulated cabinet 110. Cabinet 110 extends between a top portion 111 and a bottom portion 112, e.g., along the vertical direction V. Thus, top and bottom portions 111, 112 of cabinet 110 are spaced apart from each other, e.g., along the vertical direction V. Cabinet 110 also extends between a first side portion 113 and a second side portion 114, e.g., along the lateral direction L. Thus, first and second side portions 113, 114 of cabinet 110 are spaced apart from each other, e.g., along the lateral direction L. For example, from the perspective of a user standing in front of the oven appliance 100, e.g., to reach into one of the cavities and/or to access the controls, the first side portion 113 may be a right side portion and the second side portion 114 may be a left side portion. Cabinet 110 further extends between a front portion 115 and a back portion 116, e.g., along the transverse direction T. Thus, front and back portions 115, 116 of cabinet 110 are spaced apart from each other, e.g., along the transverse direction T.

In the illustrated example, the oven appliance 100 includes a cooktop 130 positioned at or adjacent top portion 111 of cabinet 110. Cooktop 130 includes various heating elements 132, such as gas burners, electric resistance elements, induction elements, etc., that are configured for heating cookware positioned thereon. In additional embodiments, the oven appliance 100 may be a built-in oven or a wall oven, e.g., without a cooktop 130 thereon.

As indicated in FIG. 1, cabinet 110 also defines an upper cooking chamber 120 and a lower cooking chamber 124. Thus, oven appliance 100 is generally referred to as a double oven range appliance. As will be understood by those skilled in the art, range appliance 100 is provided by way of example only, and the present subject matter may be used in any suitable multi-cavity oven appliance, e.g., a triple cavity oven appliance (or more), a double cavity wall oven appliance, etc., in various combinations.

Upper cooking chamber 120 is positioned at or adjacent top portion 111 of cabinet 110. Conversely, lower cooking chamber 124 is positioned at or adjacent bottom portion 112 of cabinet 110. Thus, upper and lower cooking chambers 120, 124 are spaced apart from each other along the vertical direction V. Upper and lower cooking chambers 120, 124 can have any suitable size relative to each other. For example, as shown in FIG. 1, upper cooking chamber 120 may be smaller than lower cooking chamber 124.

Upper and lower cooking chambers 120, 124 are configured for receipt of one or more food items to be cooked. The upper door 121 and the lower door 125 are movably attached or coupled to cabinet 110, e.g., rotatably coupled with hinges, in order to permit selective access to upper cooking chamber 120 and lower cooking chamber 124, respectively. Handles 123, 127 are mounted to upper and lower doors 121, 125 to assist a user with opening and closing doors 121, 125 in order to access cooking chambers 120, 124. As an example, a user can pull on handle 123 mounted to upper door 121 to open or close upper door 121 and access upper cooking chamber 120. Glass window panes 122, 126 provide for viewing the contents of upper and lower cooking chambers 120, 124 when doors 121, 125 are closed and also assist with insulating upper and lower cooking chambers 120, 124.

A control panel 140 of oven appliance 100 is positioned at top portion 111 and back portion 116 of cabinet 110. Control panel 140 includes user inputs 142. Control panel 140 provides selections for user manipulation of the operation of oven appliance 100. For example, a user can touch control panel 140 to trigger one of user inputs 142. In response to user manipulation of user inputs 142, various components of the oven appliance 100, such as various heating elements, can be operated.

As may be seen in FIGS. 2 through 12, upper cooking chamber 120 and lower cooking chamber 124 may be thermally isolated from one another. For example, insulation 150 may extend between the upper cooking chamber 120 and the lower cooking chamber 124, e.g., along the vertical direction V.

The oven appliance 100 generally includes one single heating element per cavity and each heating element is configured to provide heat, e.g., convection heat via heated air, to the corresponding cavity. Thus, in the illustrated example embodiment, the oven appliance includes a first heating element 160 and a second heating element 162 which are configured to provide heat, e.g., convection heat via heated air, to the upper and lower cooking chambers 120 and 124, respectively. Heating elements 160 and 162 may be any suitable type of heating element, such as electric resistance heating elements, gas burners, microwave elements, etc. In some embodiments, more than one type of heating element may be provided, e.g., the first heating element 160 may be an electric resistance heating element while the second heating element 162 may be a gas burner, among numerous other possible combinations including where the heating elements 160 and 162 are the same or different. The first heating element 160 may be in thermal communication with the upper cooking chamber 120 and the second heating element 162 may be in thermal communication with the lower cooking chamber 124. In particular embodiments, the oven appliance 100 includes one and only one heating element per cavity or cooking chamber. For example, the illustrated double oven appliance 100 includes two heating elements 160 and 162 and only two heating elements, a single one for each cooking chamber 120 and 124.

As illustrated in FIGS. 2-12, the first heating element 160 may be positioned outside of the cooking chambers 120 and 124 and the second heating element 162 may be positioned outside of the cooking chambers 120 and 124. For example, the heating elements 160 and 162 may be separated from the cooking chambers 120 and 124 by the insulation 150, such that the first heating element 160 is in thermal communication with the upper cooking chamber 120 only by convection (and is only in thermal communication with the upper cooking chamber 120, e.g., where the first heating element 160 is thermally isolated from the lower cooking chamber 124 by the insulation 150) and the second heating element 162 is in thermal communication with the lower cooking chamber 124 only by convection (and is only in thermal communication with the lower cooking chamber 124, e.g., where the second heating element 162 is thermally isolated from the upper cooking chamber 120 by the insulation 150), as will be described in more detail below. As illustrated, the insulation 150 may be positioned below the lower cooking chamber 124 along the vertical direction and above the second heating element 162 along the vertical direction V. Also, the insulation 150 may extend between the lower cooking chamber 124 and the first heating element 160 along the transverse direction T, e.g., as illustrated in FIGS. 2-12.

As mentioned above, the first heating element 160 may be in thermal communication with the upper cooking chamber 120 and the second heating element 162 may be in thermal communication with the lower cooking chamber 124. For example, the first heating element 160 may be in direct thermal communication with the upper cooking chamber 120 and the second heating element 162 may be in direct thermal communication with the lower cooking chamber 124. As will be described in more detail below, the first heating element 160 may be in direct fluid communication with the upper cooking chamber 120 and the second heating element 162 may be in direct fluid communication with the lower cooking chamber 124, whereby each heating element 160 and 162 is configured to provide heated air 1000 directly from the heating element 160 and/or 162 to the corresponding cooking chamber 120 and/or 124 when the heating element(s) 160 and/or 162 is or are activated. Such thermal communication may be provided by a plurality of ducts extending from each heating element 160 and 162 to the corresponding cooking chamber 120 and 124. For example, the oven appliance 100 may include a first duct 170 that extends from the second heating element 162 to a broil outlet 172 in the lower cooking chamber 124, a second duct 174 that extends from an inlet 176 to a bake outlet 178 in the lower cooking chamber 124, and a third duct 180 that extends between the first heating element 160 and a bake outlet 184 in the upper cooking chamber 120. In some embodiments, the third duct 180 may extend to a top heat outlet 186, as illustrated in FIGS. 2-6. In other embodiments, the third duct 180 may extend to the bake outlet 184, e.g., the third duct 180 may end at the bake outlet 184 in embodiments where, e.g., the top heat outlet 186 is not provided, such as the example embodiment illustrated in FIGS. 8 through 12. The oven appliance 100 may also include a fan 190 positioned and configured to urge air from the second heating element 162 into the second duct 174. As will be described in more detail below, selective activation or deactivation of the fan 190 may provide thermal communication from the second heating element 162 to one of the outlets 172 and 178 in the lower cooking chamber 124.

Figure 2:
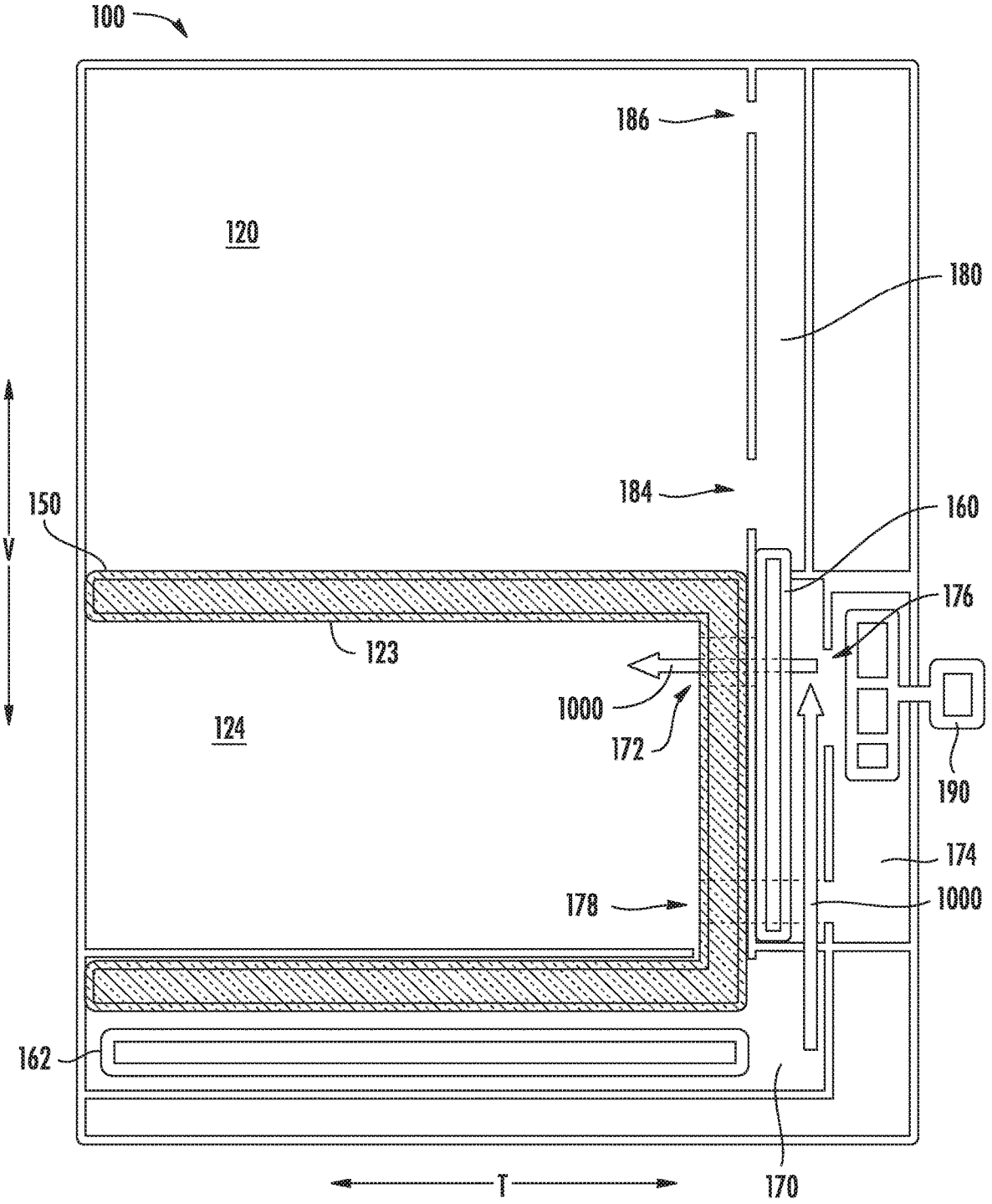
FIG. 2 provides a schematic illustration of a multi-cavity oven appliance according to one or more exemplary embodiments of the present subject matter in a first operating mode.

Turning now specifically to FIG. 2, a lower cooking chamber 124 broil operation is illustrated schematically. As shown, the second heating element 162 may be in thermal communication with the lower cooking chamber 124 via the first duct 170. In particular, the second heating element 162 may be in thermal communication with the broil outlet 172 of the lower cooking chamber 124. As will be understood by those of ordinary skill in the art, the broil outlet 172 may be positioned at or near a top wall 123 of the lower cooking chamber 124. For example, in some embodiments, the broil outlet 172 of the lower cooking chamber 124 may be proximate the top wall 123 as illustrated, e.g., in FIG. 2. Where the second heating element 162 is positioned below the lower cooking chamber 124 as in the illustrated example embodiment, heated air 1000 from the second heating element 162 will flow, e.g., rise, from the second heating element 162 into and through the first duct 170 to the broil outlet 172 by natural convection. Thus, the second heating element 162 and the lower cooking chamber 124 may be configured for thermal communication from the second heating element 162 to the broil outlet 172 in the lower cooking chamber 124 by natural convection. For example, the heated air 1000 may rise to the broil outlet 172 when the second heating element 162 is activated and the fan 190 is deactivated. Additionally, in FIG. 2 the first heating element 160 is deactivated.

Figure 3:
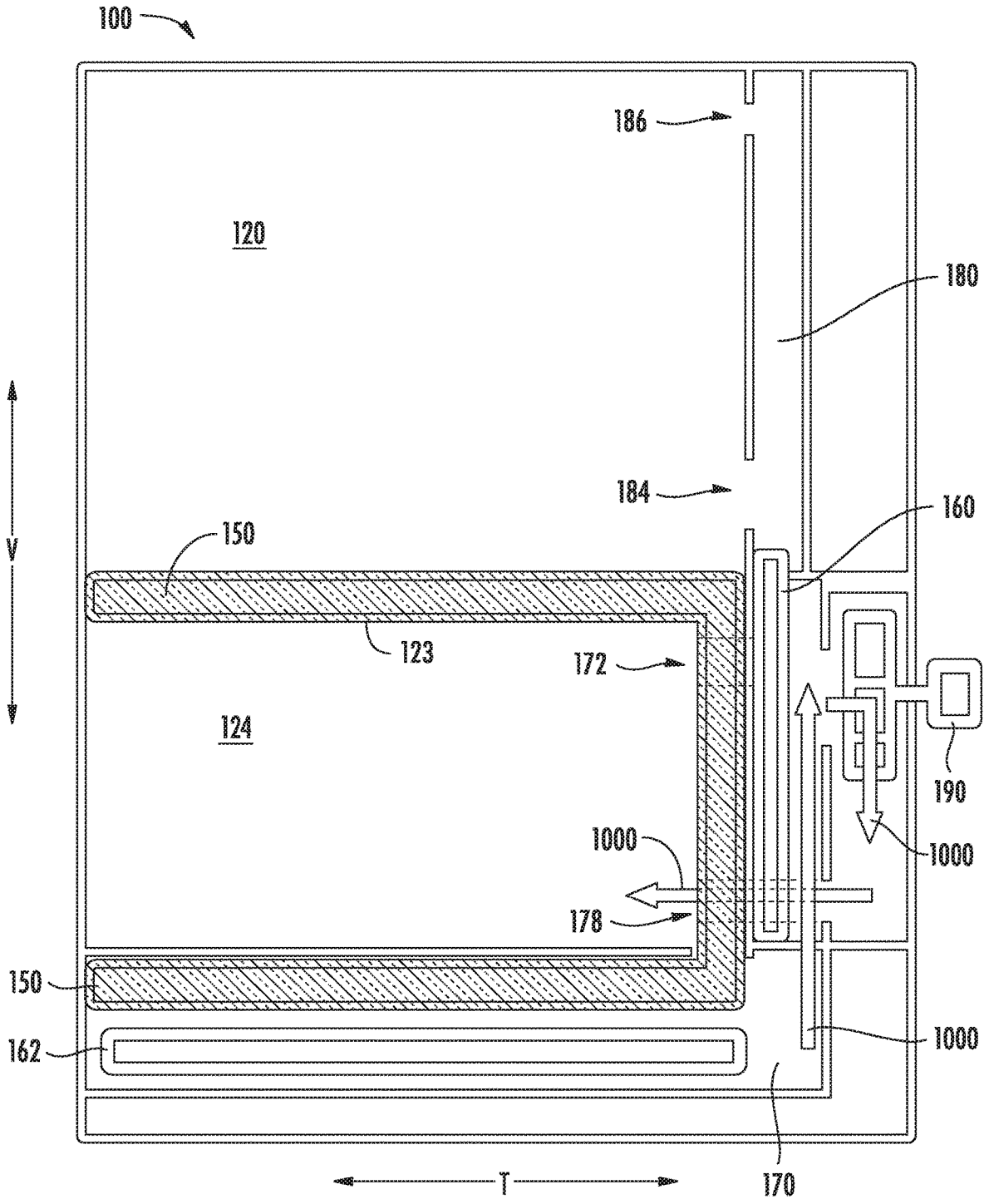
FIG. 3 provides a schematic illustration of the multi-cavity oven appliance of FIG. 2 a second operating mode.

Turning now to FIG. 3, a bake operation in the lower cooking chamber 124 is schematically depicted, e.g., where heated air 1000 is provided to the bake outlet 178 of the lower cooking chamber 124. As shown, when the fan 190 is activated, the heated air 1000 rising through the first duct 170 may be diverted from a natural path and forced or urged by the fan 190 into the second duct 174, such as via the inlet 176 of the second duct 174, as illustrated. Thus, the fan 190 may provide forced convection from the second heating element 162 to the bake outlet 178 of the lower cooking chamber 124. As shown, the inlet 176 of the second duct 174 may be positioned in the first duct 170 and/or in fluid communication with the first duct 170. The inlet 176 maybe positioned below the broil outlet 172 along the vertical direction V. For example, the inlet 176 of the second duct 174 may be positioned vertically below the broil outlet 172 in the lower cooking chamber 124. Also by way of example, the inlet 176 of the second duct 174 may be positioned vertically above the bake outlet 178 in the lower cooking chamber 124. Thus, in at least some embodiments, the inlet 176 of the second duct 174 may be positioned at an intermediate point in the first duct 170 between the second heating element 162 and the broil outlet 172 in the lower cooking chamber 124. Where the inlet 176 of the second duct 174 is below the broil outlet 172, the heated air 1000 may be diverted from the natural path by the fan 190 before the heated air 1000 reaches the broil outlet 172 and the heated air 1000 may then be routed through the second duct 174 to the bake outlet 178, e.g., the heated air 1000 may be diverted from the first duct 170 and urged into and through the second duct 174 by the fan 190.

Figure 4:
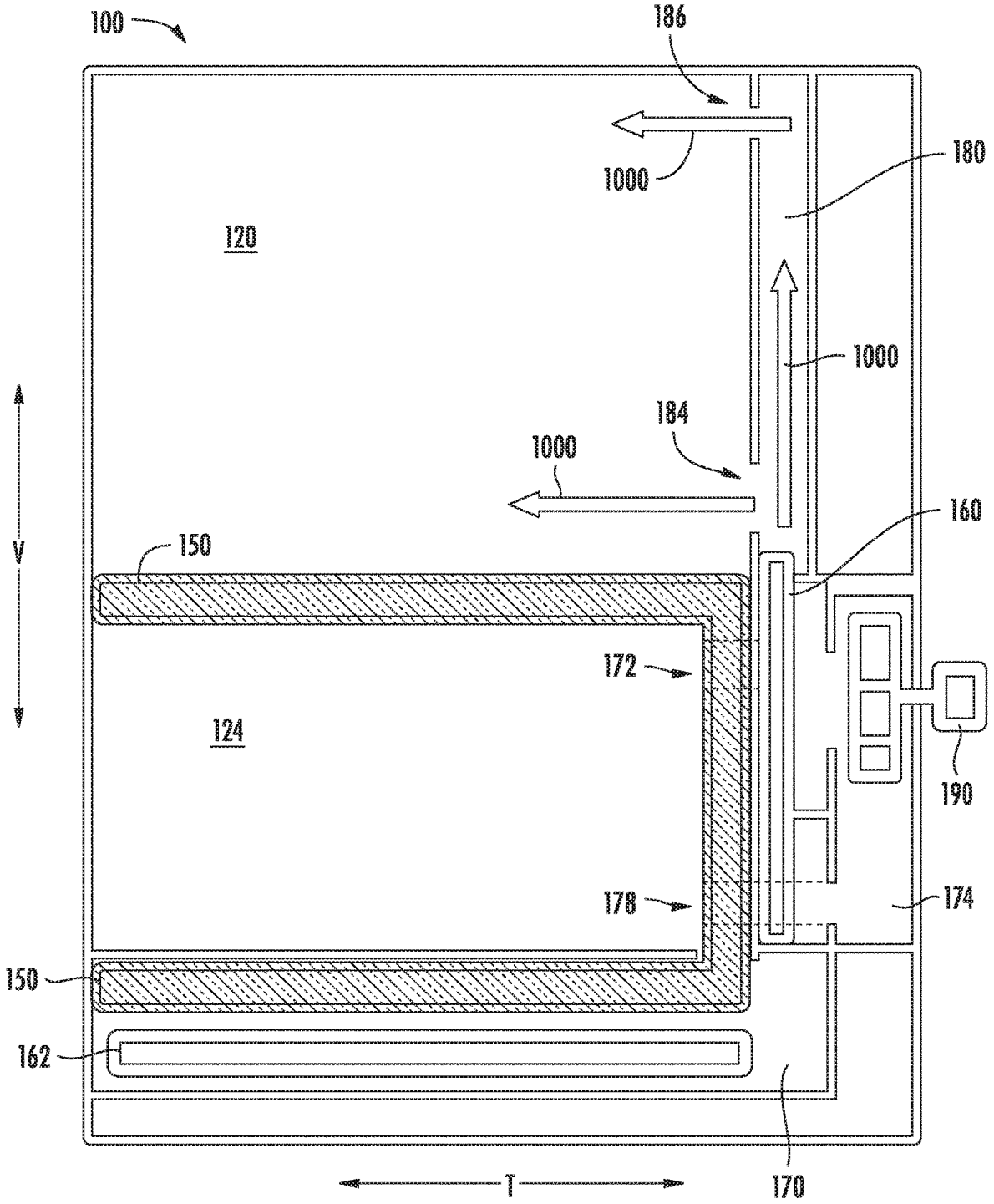
FIG. 4 provides a schematic illustration of the multi-cavity oven appliance of FIG. 2 in a third operating mode.

Turning now to FIG. 4, a bake operation in the upper cooking chamber 120 is schematically depicted, e.g., where heated air 1000 is provided to the bake outlet 184 of the upper cooking chamber 120. As shown, the first heating element 160 may be in thermal communication with the upper cooking chamber 120 via the third duct 180. In particular, the first heating element 160 may be in thermal communication with the bake outlet 184 of the upper cooking chamber 120 and, optionally, the top heat outlet 186. Thus, when the first heating element 160 is activated, the heated air 1000 may rise through the third duct 180 to the bake outlet 184. Where the first heating element 160 is positioned below the upper cooking chamber 120, e.g., along the vertical direction V, as in the illustrated example embodiment, heated air 1000 from the first heating element 160 will flow, e.g., rise, from the first heating element 160 into and through the third duct 180 to the bake outlet 184 by natural convection. Thus, the first heating element 160 and the upper cooking chamber 120 may be configured for thermal communication from the heating element 160 to the bake outlet 184 in the upper cooking chamber 120 by natural convection. For example, the heated air 1000 may rise to the bake outlet 184 when the first heating element 160 is activated, without any fan or other air handler to move the heated air 1000 to the bake outlet 184 and, in some embodiments, the top heat outlet 186.

Figure 5:
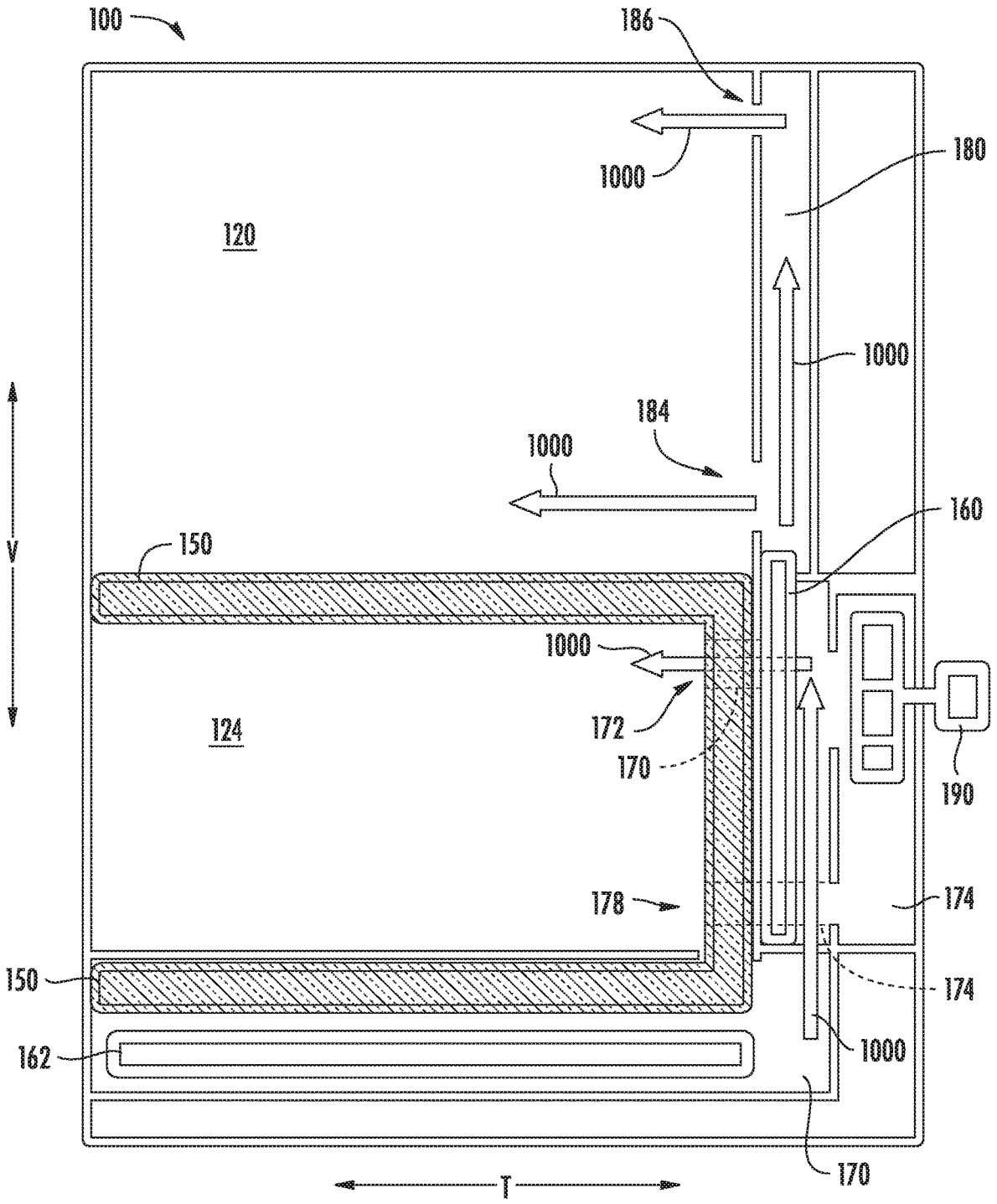
FIG. 5 provides a schematic illustration of the multi-cavity oven appliance of FIG. 2 in a fourth operating mode.
Figure 6:
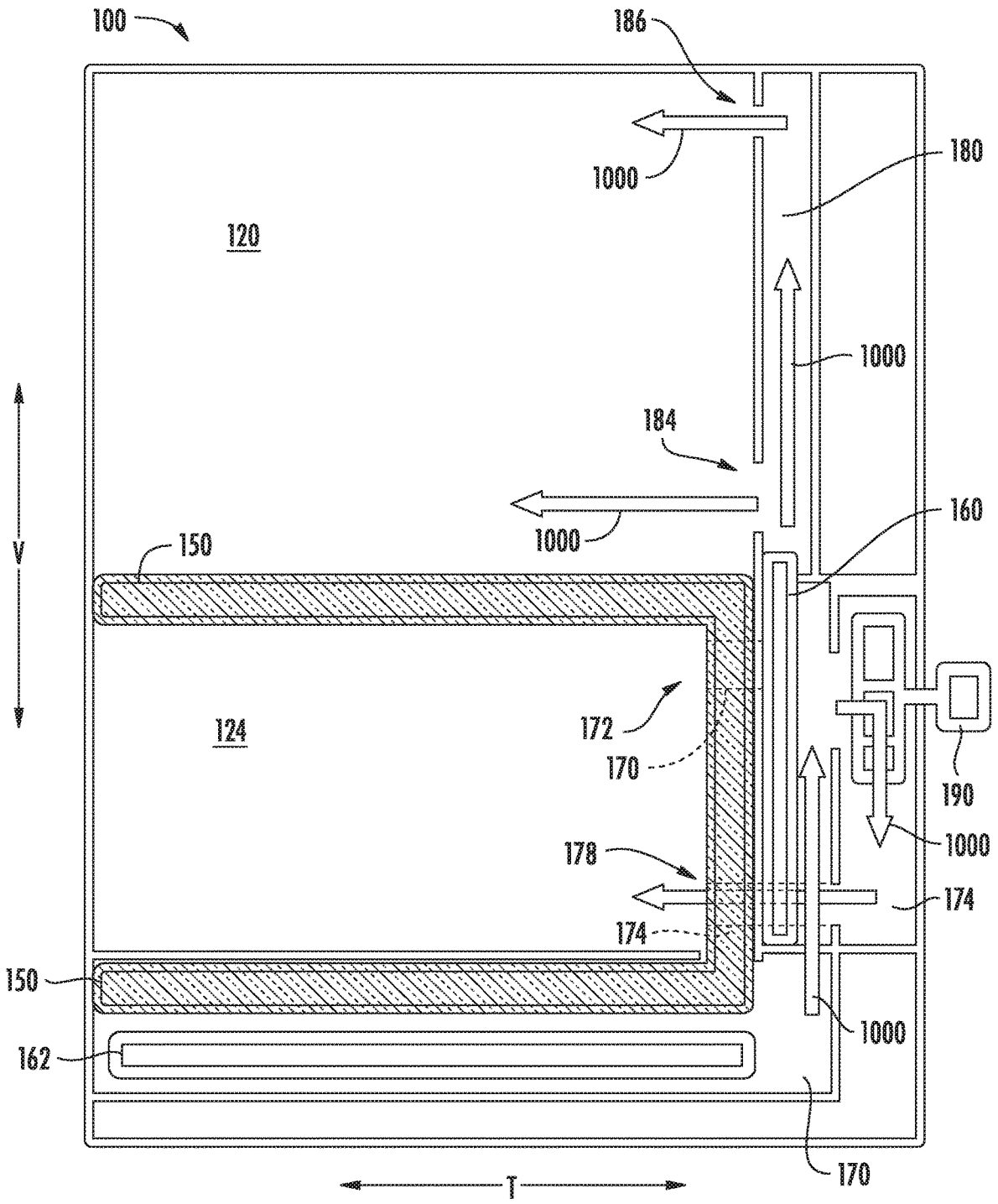
FIG. 6 provides a schematic illustration of the multi-cavity oven appliance of FIG. 2 in a fifth operating mode.

As illustrated in FIGS. 5 and 6, the upper cooking chamber 120 and the lower cooking chamber 124 may be configured for simultaneous and independent operation. For example, as illustrated in FIG. 5, when both the first heating element 160 and the second heating element 162 are activated and the fan 190 is deactivated, a bake operation may be performed in the upper cooking chamber 120, as described above with reference to FIG. 4, while a broil operation is also performed in the lower cooking chamber 124, as described above with reference to FIG. 2. As another example, as illustrated in FIG. 6, when both the first heating element 160 and the second heating element 162 are activated and the fan 190 is also activated, a bake operation may be performed in the upper cooking chamber 120 while a bake operation is also performed in the lower cooking chamber 124, as described above with reference to FIG. 3.

Figure 7:
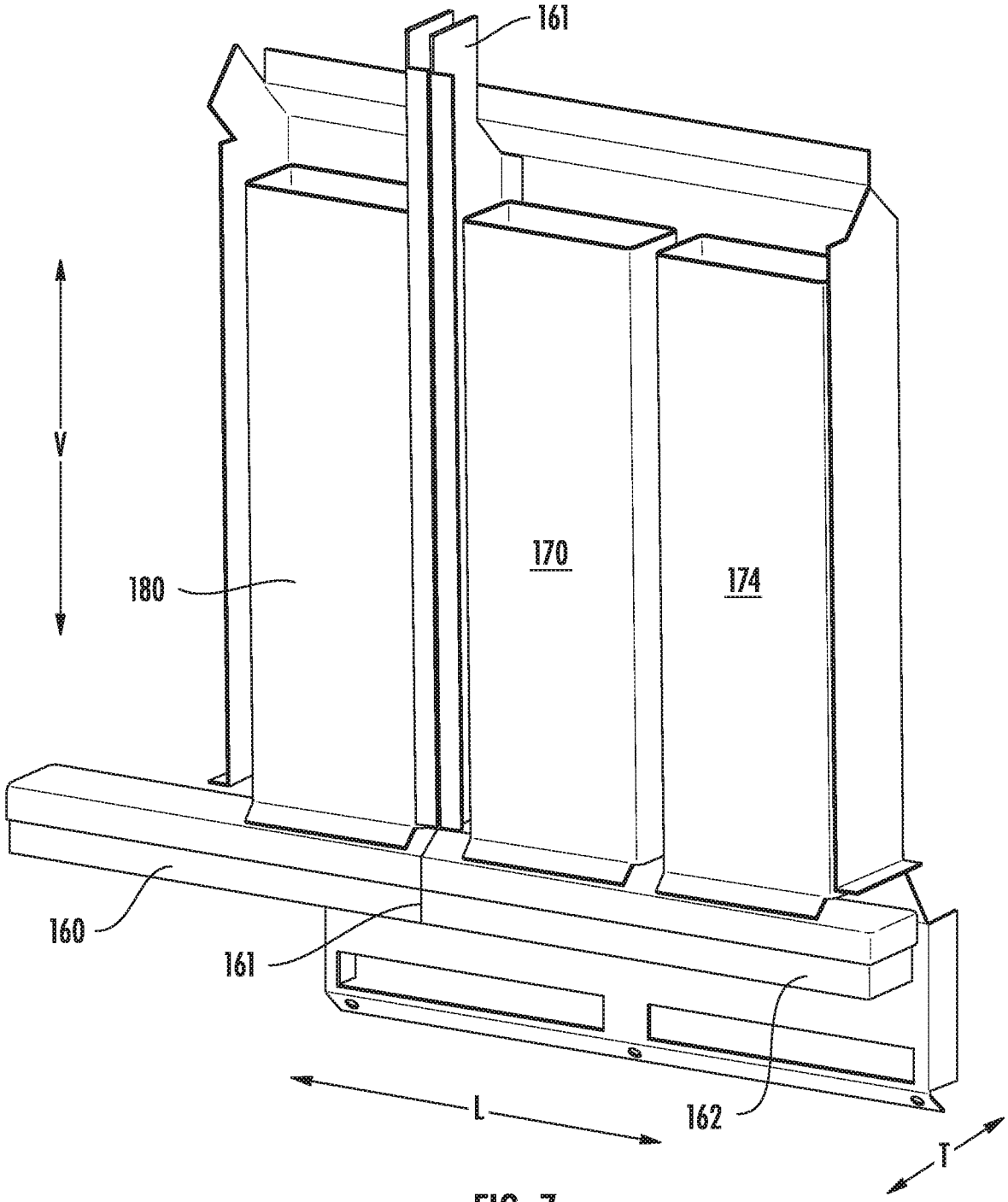
FIG. 7 provides a perspective view of portions of a plurality of heat sources and associated ducts which may be incorporated into a multi-cavity oven appliance according to one or more exemplary embodiments of the present subject matter.

FIG. 7 schematically depicts portions of a first heating element 160 and a second heating element 162 and portions of associated first duct 170, second duct 174, and third duct 180, according to some example embodiments of the present subject matter. As shown in FIG. 7, the ducts 170, 174, and 180 may be aligned along the vertical and transverse directions V and T and spaced along the lateral direction L. Also as may be seen in FIG. 7, the first and second heating elements 160 and 162 may be aligned along the vertical and transverse directions V and T and spaced along the lateral direction L. For example, the first and second heating elements 160 and 162 may be spaced apart and separated from each other by a partition 161. The first duct and the second duct 174 may be in thermal communication with the second heating element 162 on one side of the partition 161 and the third duct 180 may be in thermal communication with the first heating element 160 on the other side of the partition 161. As mentioned above, in some embodiments the heating elements 160 and 162 may be, e.g., gas burners. For example, the first and second heating elements 160 and 162 which are aligned as shown in FIG. 7 may each be a gas burner. The various outlets, e.g., bake outlets 178 and 184 and broil outlet 172 are omitted from FIG. 7.

FIGS. 8 through 12 schematically depict a multi-cavity oven appliance 100 according to another example embodiment. For example, in contrast to the embodiment illustrated in FIGS. 2 through 6 where the heating elements 160 and 162 are separated, the heating elements 160 and 162 may be aligned as depicted in FIG. 7 in the embodiment illustrated by FIGS. 8 through 12. Additionally, while the illustrated embodiment of FIGS. 2-6 includes the fan 190 positioned at or near the back portion 116 (FIG. 1) of the oven appliance 100, the embodiment illustrated in FIGS. 8 through 12 includes the fan 190 positioned near the bottom portion 112 (FIG. 1) of the oven appliance 100. Such examples are provided by way of illustration only and additional configurations and combinations may be provided, e.g., the aligned ducts of FIGS. 7-12 may be provided with a back fan 190 as illustrated in FIGS. 2-6, among other possible combinations and variations.

Additional details of the oven appliance 100 are also illustrated in FIGS. 8-12 for context but are not limiting of the embodiment illustrated in FIGS. 8-12 nor limited to the embodiment of FIGS. 8-12. For example, as illustrated in FIGS. 8-12, the cooking chambers 120 and 124 may be partially defined by one or more side walls 156. Each side wall or side walls 156 may include or define embossed supports 157, e.g., that extend along the transverse direction T. Embossed supports 157 may be distributed along the vertical direction V, and each embossment 157 on one of side walls 156 may be aligned with a respective embossment 157 on an opposing side wall 156 (e.g., another side wall 156 spaced apart along the lateral direction L). A rack (not shown) may be supported on embossed supports 157. For example, the rack may be inserted between adjacent embossed supports 157 on each side wall 156. The side walls 156 and embossed supports 157 are shown in FIGS. 8-12 by way of example only. As mentioned above, the side walls 156 and embossed supports 157 may also be included in the embodiment of FIGS. 2-6 and/or may be omitted from the embodiment of FIGS. 8-12.

Figure 8:
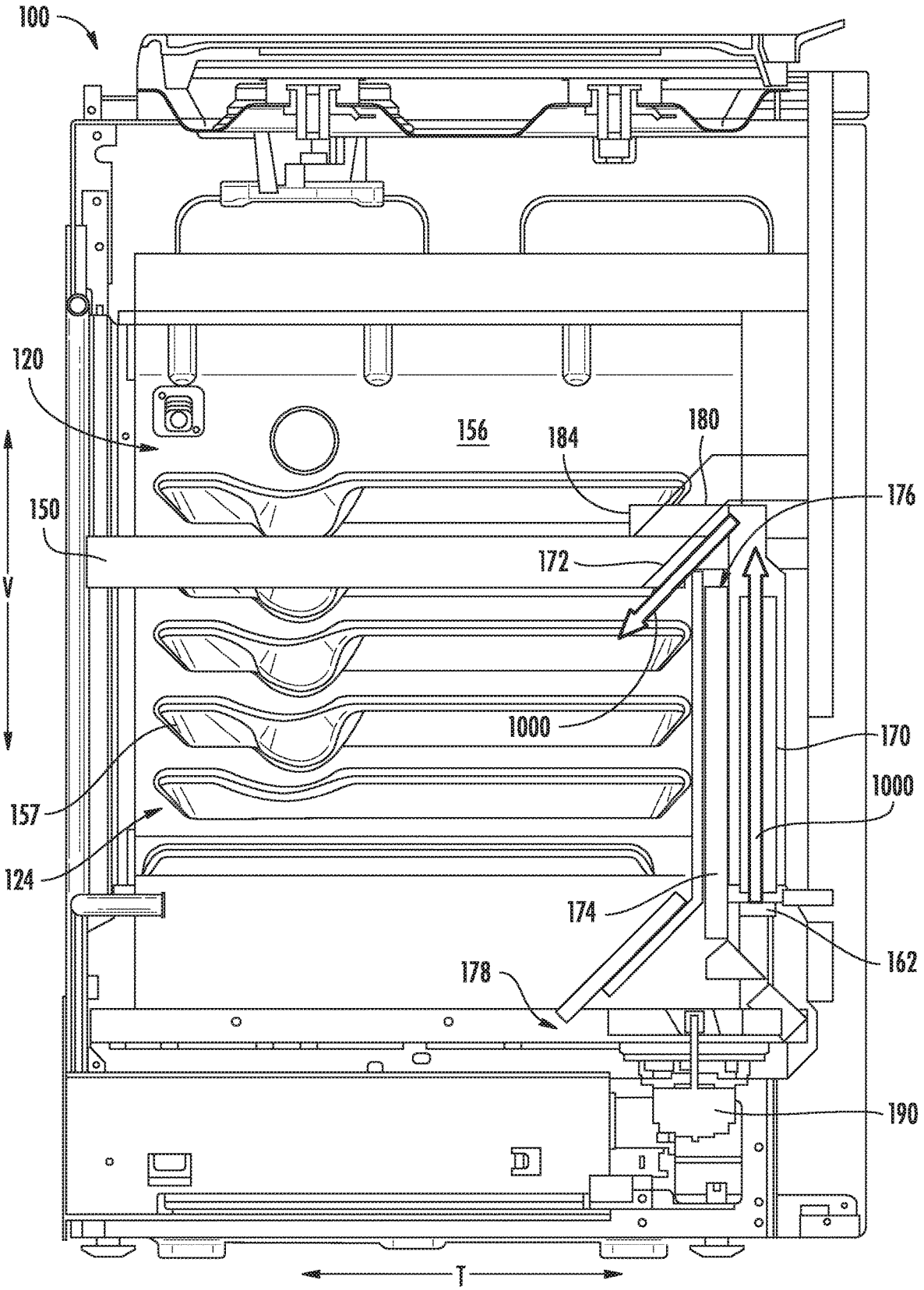
FIG. 8 provides a schematic illustration of a multi-cavity oven appliance according to one or more additional exemplary embodiments of the present subject matter in a first operating mode.
Figure 9:
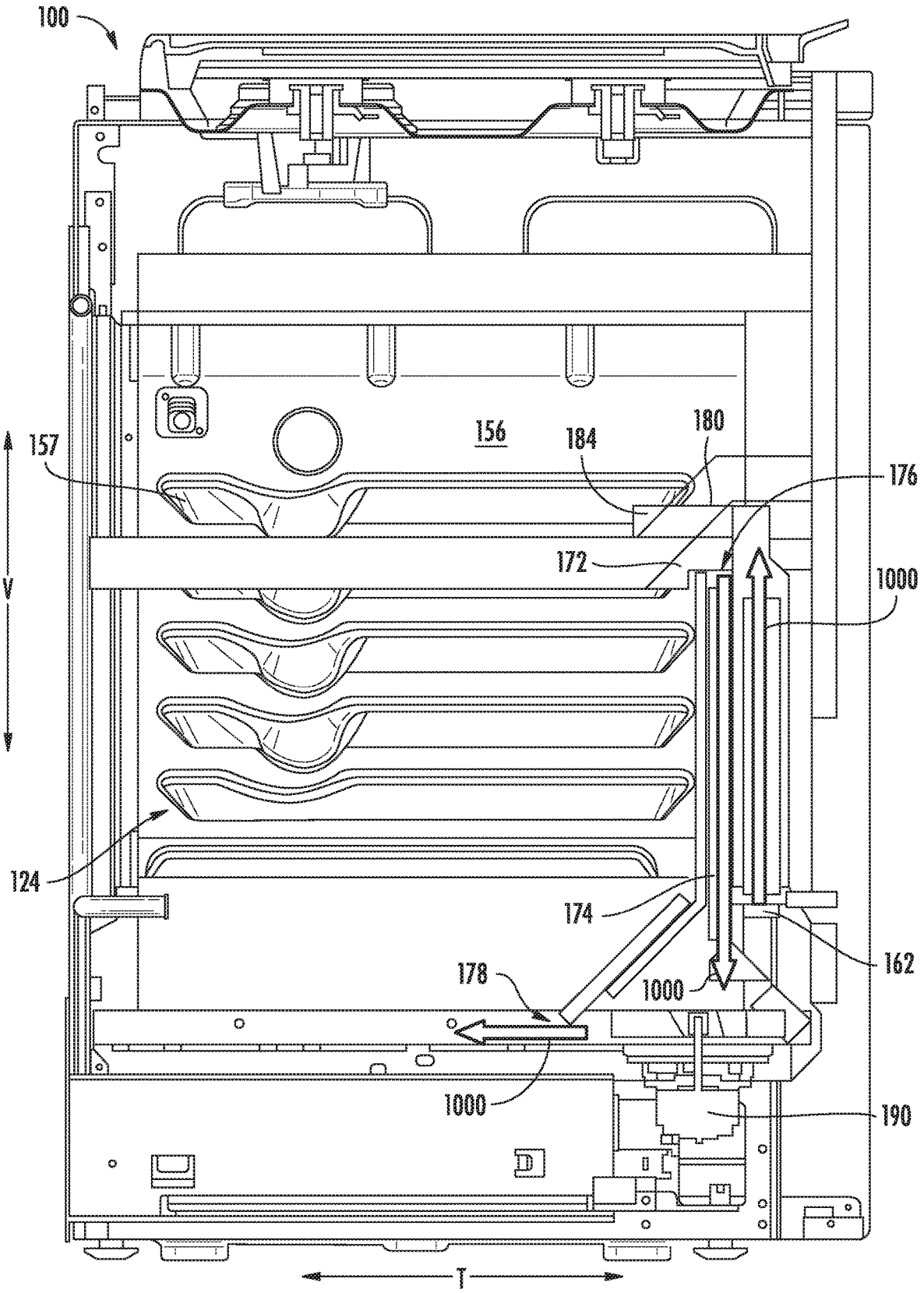
FIG. 9 provides a schematic illustration of the multi-cavity oven appliance of FIG. 8 a second operating mode.

FIG. 8 illustrates a broil operation in the lower cooking chamber 124, where the heated air 1000 is provided to the broil outlet 172 in the lower cooking chamber 124 by natural convection from the second heating element 162 via the first duct 170. As illustrated, the broil outlet 172 may be oriented downward along the vertical direction V into the lower cooking chamber 124, where the first duct 170 may include an oblique portion which extends downward along the vertical direction V (e.g., towards the bottom portion 112) and forward along the transverse direction T (e.g., towards the front portion 115). FIG. 9 illustrates a bake operation in the lower cooking chamber 124. As mentioned above, the inlet 176 of the second duct 174 may be positioned at an intermediate point in the first duct 170. For example, as illustrated in FIG. 9, the intermediate point may be in the oblique portion of the first duct 170 just upstream (e.g., behind along the transverse direction T) of the broil outlet 172. In such embodiments, when the fan 190 is activated, the fan 190 may urge the heated air 1000 into the second duct 174 and to the bake outlet 178 in the lower cooking chamber 124.

Figure 10:
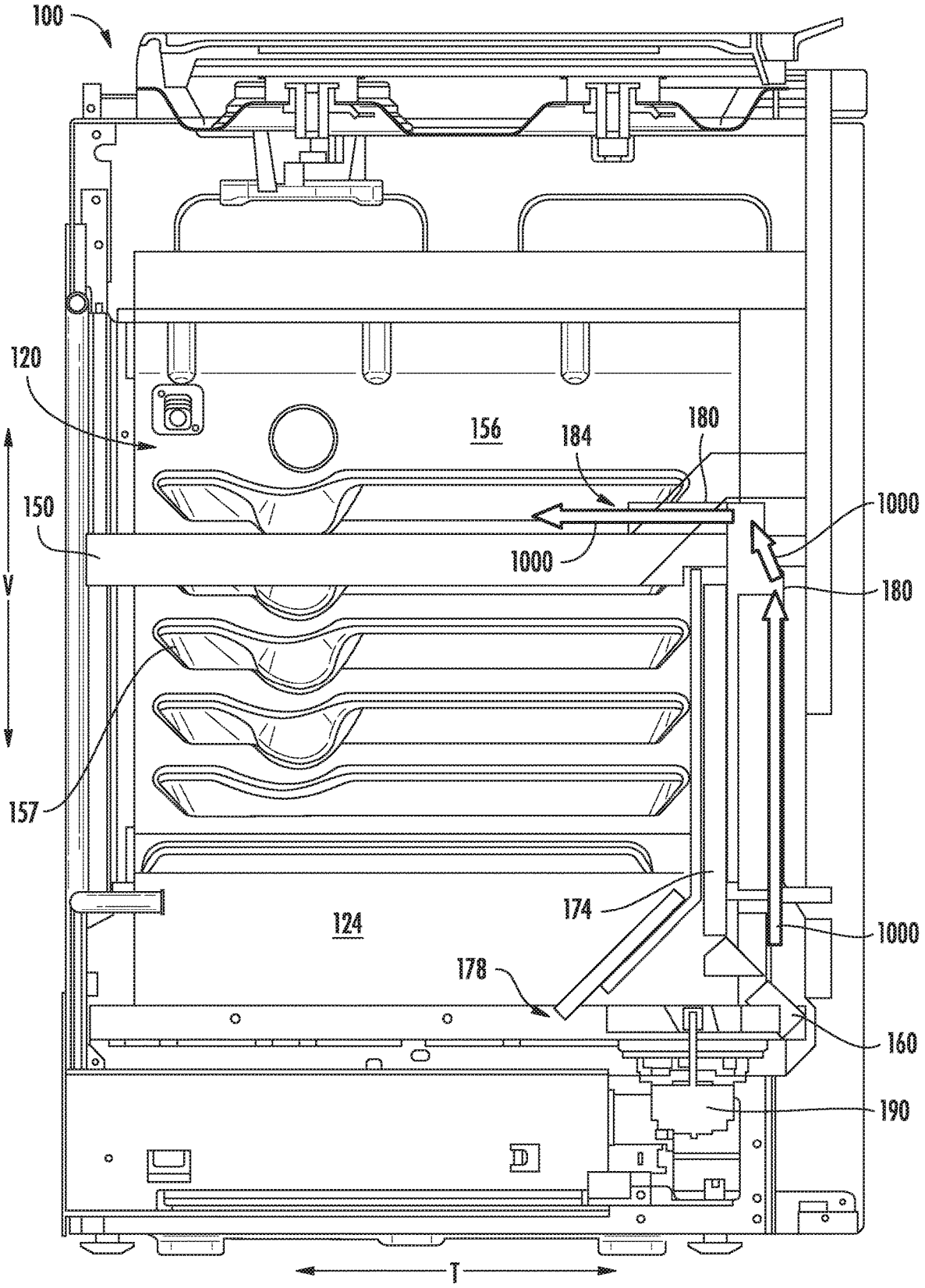
FIG. 10 provides a schematic illustration of the multi-cavity oven appliance of FIG. 8 in a third operating mode.

FIG. 10 illustrates a bake operation of the upper cooking chamber 120 of the oven appliance 100. As shown in FIG. 10, the heated air 1000 from the first heating element 160 may travel to the bake outlet 184 in the upper cooking chamber 120 by natural convection, similar to the examples in FIGS. 4-6 described above. However, in the embodiment illustrated by FIG. 10, the top heat outlet 186 in the upper cooking chamber 120 is omitted and the third duct 180 extends to the bake outlet 184.

Figure 11:
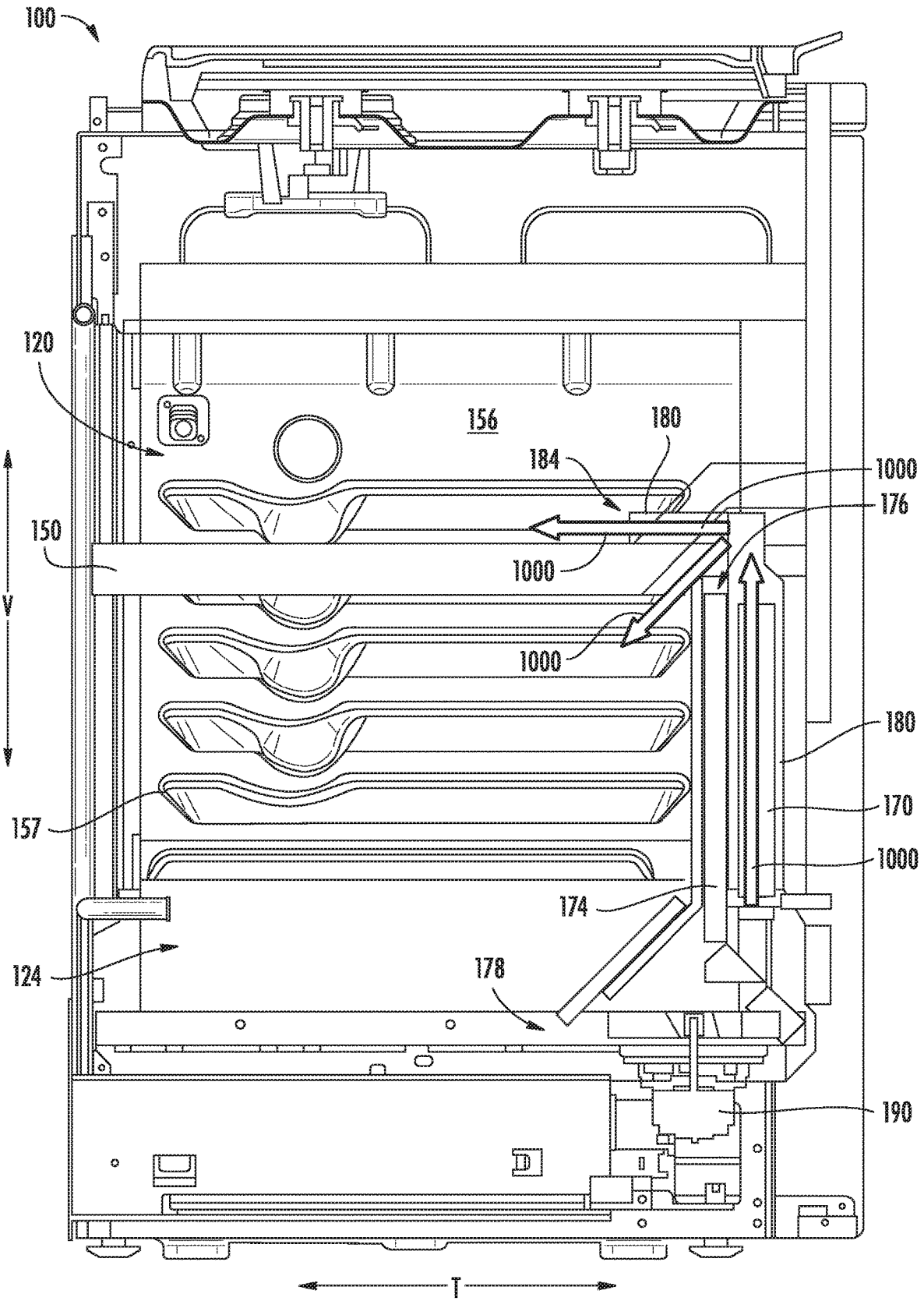
FIG. 11 provides a schematic illustration of the multi-cavity oven appliance of FIG. 8 in a fourth operating mode.
Figure 12:
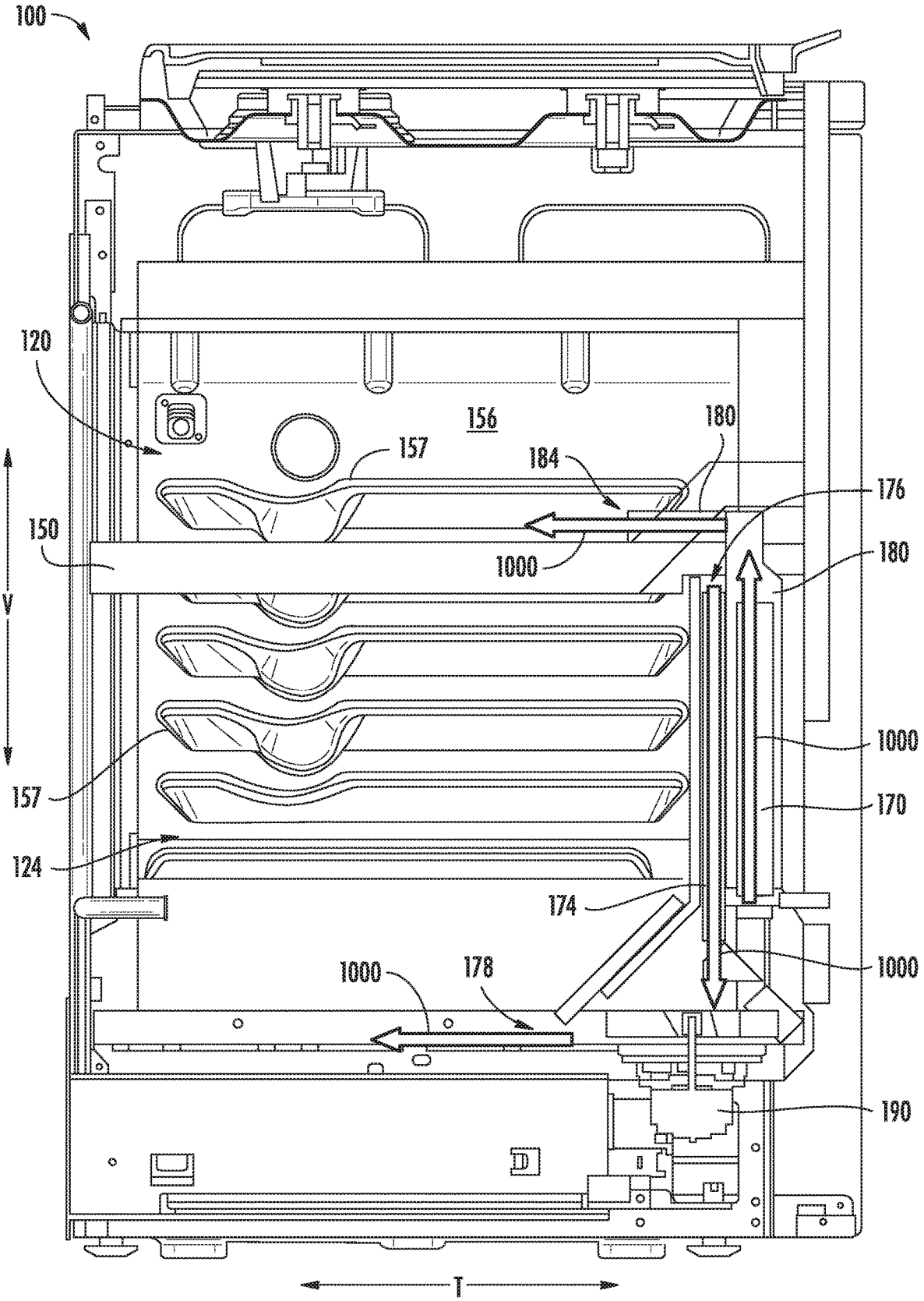
FIG. 12 provides a schematic illustration of the multi-cavity oven appliance of FIG. 8 in a fifth operating mode.

As mentioned above, the cooking chambers 120 and 126 may be operated separately and independently, e.g., as illustrated in FIGS. 11 and 12. For example, FIG. 11 illustrates a bake operation in the upper cooking chamber 120 and a broil operation in the lower cooking chamber 124 where both heating elements 160 and 162 are activated while the fan 190 is deactivated. As another example, FIG. 12 illustrates a bake operation in the upper cooking chamber 120 and a bake operation in the lower cooking chamber 124 where both heating elements 160 and 162 are activated while the fan 190 is also activated.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance defining a vertical direction, a lateral direction and a transverse direction, the vertical, lateral and transverse directions being mutually perpendicular, the oven appliance comprising:

a cabinet extending between a first side portion and a second side portion along the lateral direction, the cabinet also extending between a top portion and a bottom portion along the vertical direction, the cabinet defining an upper cooking chamber positioned adjacent the top portion of the cabinet and a lower cooking chamber positioned adjacent the lower portion of the cabinet;

a first heating element in direct thermal communication with the upper cooking chamber; and a second heating element in direct thermal communication with the lower cooking chamber;

wherein the first heating element is the only heat source for the upper cooking chamber and the second heating element is the only heat source for the lower cooking chamber, wherein the first heating element and the upper cooking chamber are configured for direct thermal communication from the first heating element to a bake outlet in the upper cooking chamber by natural convection and wherein the first heating element and the upper cooking chamber are further configured for direct thermal communication from the first heating element to a top heat outlet in the upper cooking chamber by natural convection, the top heat outlet positioned above the bake outlet in the upper cooking chamber along the vertical direction.

2. The oven appliance of claim 1, further comprising a first duct extending from the second heating element to a broil outlet in the lower cooking chamber, a second duct extending to a bake outlet in the lower cooking chamber, and a fan configured to urge heated air from the second heating element into the second duct.

3. The oven appliance of claim 2, wherein the second duct extends from an inlet to the bake outlet in the lower cooking chamber, the inlet of the second duct positioned at an intermediate point in the first duct between the second heating element and the broil outlet in the lower cooking chamber, whereby the fan is configured to divert heated air from the first duct into the second duct.

4. The oven appliance of claim 2, further comprising a third duct extending from the first heating element to the bake outlet in the upper cooking chamber.

5. The oven appliance of claim 1, wherein the second heating element and the lower cooking chamber are configured for direct thermal communication from the second heating element to a broil outlet in the lower cooking chamber by natural convection.

6. The oven appliance of claim 1, further comprising a fan configured to provide forced convection from the second heating element to a bake outlet in the lower cooking chamber.

7. The oven appliance of claim 1, wherein the upper cooking chamber is thermally isolated from the lower cooking chamber.

8. The oven appliance of claim 1, wherein the first heating element is positioned outside of the upper cooking chamber and the lower cooking chamber and the second heating element is positioned outside of the upper cooking chamber and the lower cooking chamber.

9. An oven appliance, comprising:

a cabinet;

an upper cooking chamber defined in the cabinet adjacent a top portion of the cabinet;

a lower cooking chamber defined in the cabinet below the upper cooking chamber and adjacent a lower portion of the cabinet;

a first heating element in direct thermal communication with the upper cooking chamber; and a second heating element in direct thermal communication with the lower cooking chamber wherein the first heating element is the only heat source for the upper cooking chamber and the second heating element is the only heat source for the lower cooking chamber, wherein the first heating element and the upper cooking chamber are configured for direct thermal communication from the first heating element to a bake outlet in the upper cooking chamber by natural convection and wherein the first heating element and the upper cooking chamber are further configured for direct thermal communication from the first heating element to a top heat outlet in the upper cooking chamber by natural convection, the top heat outlet positioned above the bake outlet in the upper cooking chamber along the vertical direction.

10. The oven appliance of claim 9, further comprising a first duct extending from the second heating element to a broil outlet in the lower cooking chamber, a second duct extending to a bake outlet in the lower cooking chamber, and a fan configured to urge heated air from the second heating element into the second duct.

11. The oven appliance of claim 10, wherein the second duct extends from an inlet to the bake outlet in the lower cooking chamber, the inlet of the second duct positioned at an intermediate point in the first duct between the second heating element and the broil outlet in the lower cooking chamber, whereby the fan is configured to divert heated air from the first duct into the second duct.

12. The oven appliance of claim 10, further comprising a third duct extending from the first heating element to the bake outlet in the upper cooking chamber.

13. The oven appliance of claim 9, wherein the second heating element and the lower cooking chamber are configured for direct thermal communication from the second heating element to a broil outlet in the lower cooking chamber by natural convection.

14. The oven appliance of claim 9, further comprising a fan configured to provide forced convection from the second heating element to a bake outlet in the lower cooking chamber.

15. The oven appliance of claim 9, wherein the upper cooking chamber is thermally isolated from the lower cooking chamber.

16. The oven appliance of claim 9, wherein the first heating element is positioned outside of the upper cooking chamber and the lower cooking chamber and the second heating element is positioned outside of the upper cooking chamber and the lower cooking chamber.

* * * * *